United States Patent [19]

Wilkins

[11] Patent Number: 4,807,700

[45] Date of Patent: Feb. 28, 1989

[54] WIRELINE DOWNHOLE ANNULUS VALVE

[75] Inventor: Robert L. Wilkins, Houston, Tex.

[73] Assignee: Cameron Iron Works USA, Inc., Houston, Tex.

[21] Appl. No.: 98,377

[22] Filed: Sep. 18, 1987

[51] Int. Cl.[4] ..... E21B 33/04; E21B 34/14

[52] U.S. Cl. ..... 166/86; 166/334; 166/332; 251/250; 251/341

[58] Field of Search ..... 166/86, 332, 334; 251/250, 315, 341

[56] References Cited

U.S. PATENT DOCUMENTS

| | | | |
|---|---|---|---|
| 2,785,755 | 3/1957 | En Dean | 251/250 X |
| 3,035,808 | 5/1962 | Knox | 251/250 X |
| 3,043,371 | 7/1962 | Rector | 166/86 |
| 3,283,835 | 11/1966 | Keller | 166/334 X |
| 3,360,235 | 12/1967 | Myers | 251/341 X |
| 3,601,190 | 8/1971 | Mott | 166/85 |
| 3,724,501 | 4/1973 | Scott | 251/250 X |
| 3,796,257 | 3/1974 | Hudson | 166/363 |
| 3,815,675 | 6/1974 | Peters | 166/332 X |
| 4,050,512 | 9/1977 | Giebeler | 166/334 X |
| 4,331,315 | 5/1982 | Geisow | 166/332 X |
| 4,340,088 | 7/1982 | Geisow | 166/332 X |
| 4,422,618 | 12/1983 | Lawson | 166/332 X |
| 4,520,994 | 6/1985 | De Wald | 166/332 X |
| 4,721,132 | 1/1988 | Houlgrave | 166/332 X |

*Primary Examiner*—Jerome W. Massie, IV
*Assistant Examiner*—John F. Letchford
*Attorney, Agent, or Firm*—Vinson & Elkins

[57] ABSTRACT

An improved tubing hanger having an annulus passageway therethrough and with an improved annulus control valve therein including an annular hanger body having an annulus passageway extending therethrough with a chamber interrupting said passageway and a valve ball positioned within said chamber for rotation responsive to rotation of gear means associated with said valve ball, a sleeve slidably positioned within said hanger body and having a rack secured thereto and engaging said gear means so that movement of said sleeve controls the position of said valve ball to open and close flow through said annulus passageway.

5 Claims, 3 Drawing Sheets

WIRELINE DOWNHOLE ANNULUS VALVE

BACKGROUND

Wells may be completed through dual or side-by-side tubing strings or through concentric tubing. In both applications, access to the tubing annulus is provided. The side-by-side application allows wireline access to the annulus for the purpose of setting a seal plug in the tubing hanger. Another annulus bore seal method in the tubing hanger would eliminate the need for wireline access allowing use of a concentric design. Difficulties have been encountered in the past with the side-by-side arrangement in that orientation of the hangers has been a problem and the side-by-side arrangement is more expensive. Since concentric tubing strings greatly simplify the riser, the need for a second bore in the annulus through the riser and tree valve block is eliminated and larger production tubing sizes can be used in smaller casing.

Prior to the present invention, concentric designs have been offered which provide a sting open back pressure valve in the top of the hanger annulus through bore. This valve is stung open by the tree to ensure communication with the annulus for monitoring, killing and injecting in the tree-installed position. This design totally relies on the back pressure valve for sealing of the annulus should pressure build up in the annulus. This is not desirable since the valve cannot be tested until the tree is removed and killing the well if a pressure build-up had occurred in the annulus prior to the tree removal is usually not a preferred method of operating.

Various solutions have been offered in the past to the problem of having a valve controlling the annulus which is not reliant upon the tree stinger but can be controlled by hydraulic or wireline operations. One proposal is to use a hydraulically operated sleeve controlling one or more ports in the top of the tubing hanger but this could result in the annulus being permanently opened in the event of failure of the hydraulic control system.

Another solution has been suggested which is to use a fail safe spring with the sleeve valve. This is an improvement but still suffers from resulting in a fail open or fail closed with no other flexibility.

It has also been proposed to use a wireline operated sliding sleeve to open up or seal off annulus porting. These suggested solutions require the use of an internal sleeve valve in the production bore or an external sleeve valve which is hydraulically operated.

Down hole ball valves have long been used in production strings as shown in U.S. Pat. Nos. 3,035,808 and 3,796,257 which disclose fluid operated downhole ball valves; U.S. Pat. No. 3,601,190 which discloses a dual string pressure responsive ball valves in the parallel tubing strings; and U.S. Pat. No. 3,815,675 which discloses a single string ball valve operated by wireline.

SUMMARY

The present invention provides an improved tubing hanger with an improved downhole annulus control valve which is operated by wireline. The improved valve includes a passageway through the concentric tubing hanger providing annulus communication from the opposite sides of the tubing hanger, the passageway is separated in an opening with the opposite ends of of the passageway forming spherical seats facing the opening, a ball valve having a bore therethrough mounted on shafts extending outward from said ball transversely to the bore through the ball and with the ball in position between the spherical seats, one of said shafts rotating with said ball, a pinion gear secured to said shaft and having its inner portion exposed to the interior of said tubing hanger, a sleeve positioned within said tubing hanger, a rack on the exterior of the sleeve in engagement with said pinion gear and the sleeve being slidable axially within the tubing hanger from a first position in which said ball valve is open to a second position in which said ball valve is closed blocking flow through the annulus passage. The sleeve is provided with a suitable internal configuration so that it can be moved with a suitable tool lowered through the string into the tubing hanger.

An object of the present invention is to provide an improved tubing hanger structure for concentric strings and having improved annulus control valve.

Another object is to provide an improved tubing hanger annulus control valve which provides a metal-to-metal seating when it is closed.

A further object is to provide an improved tubing hanger annulus control valve which may be operated remotely either hydraulically or by wireline.

A still further object is to provide an improved tubing hanger annulus control valve which can be positively moved between its open and closed positions.

Still another object is to provide an improved tubing hanger annulus control valve which is easily and positively operated in wells in deep underwater locations.

BRIEF DESCRIPTION OF THE DRAWINGS

These and other objects and advantages are herein after set forth and explained with reference to the drawings wherein.

DESCRIPTION OF THE PREFERRED EMBODIMENT

Figure 1:
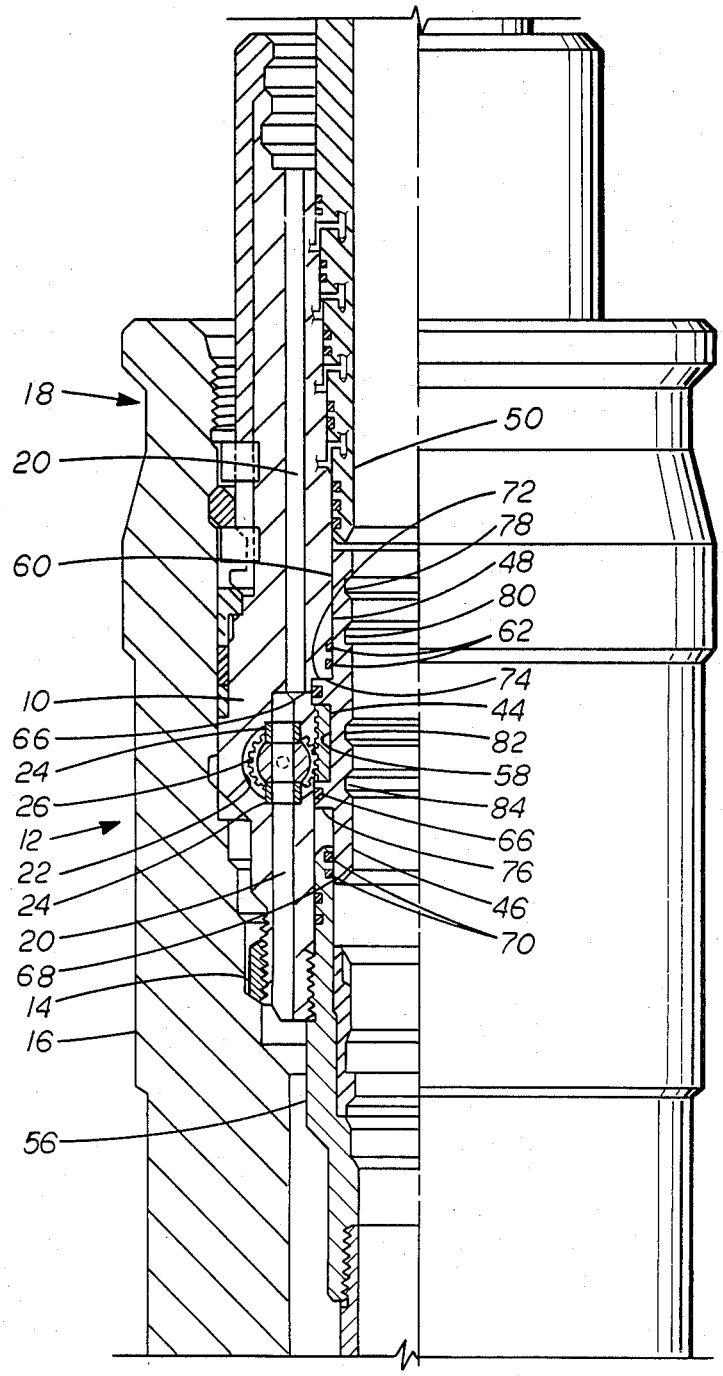
FIG. 1 is an elevation view having the left portion in section of the improved tubing hanger annulus valve.
Figure 3:
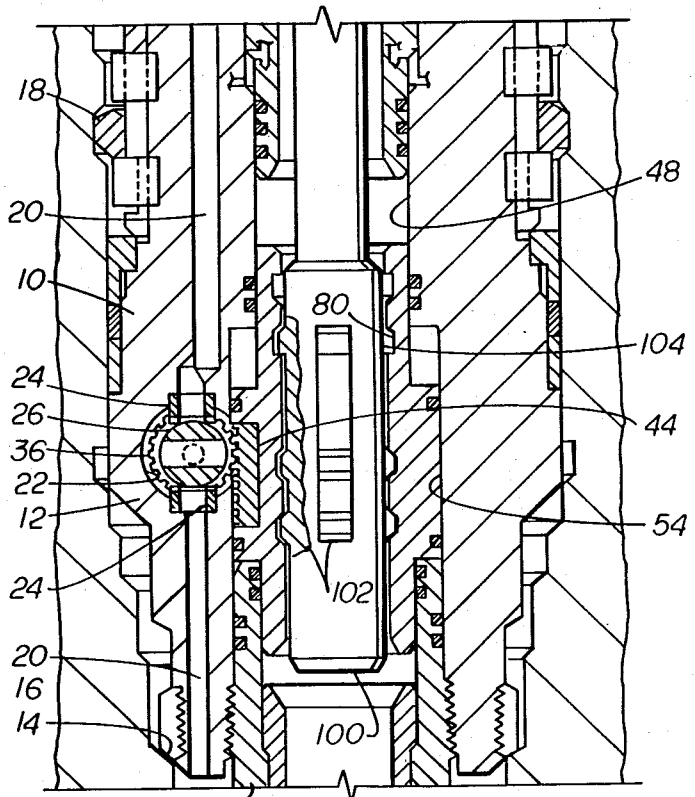
FIG. 3 is a view similar to FIG. 2 but showing the valve in closed position.
Figure 4:
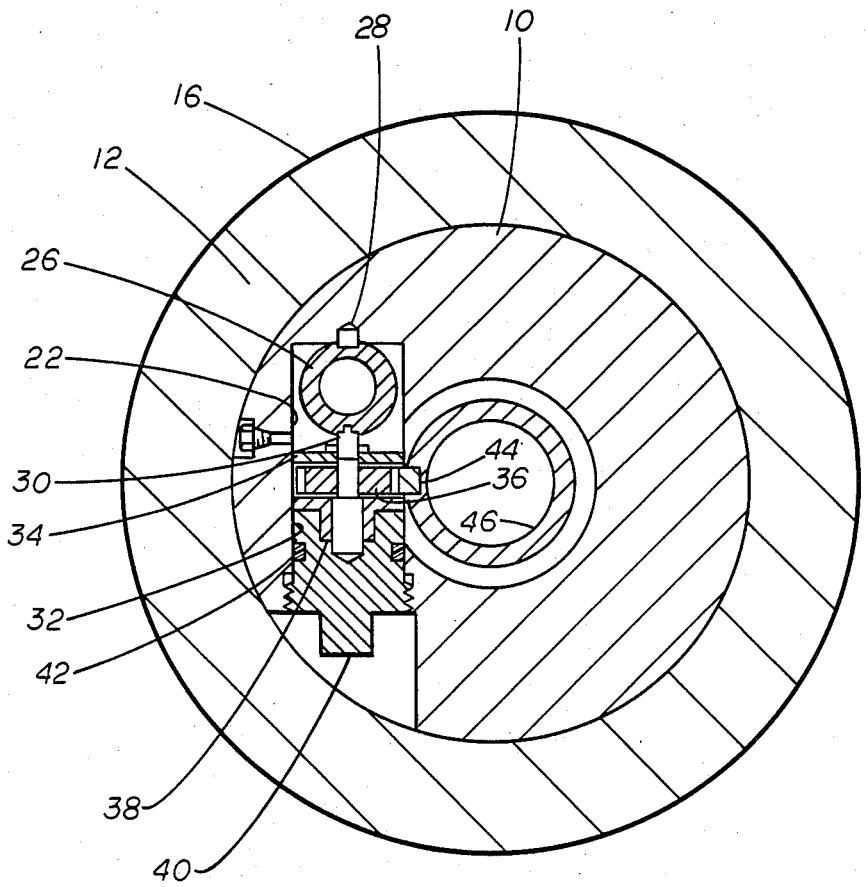
FIG. 4 is a sectional view of the ball valve and its operating mechanism taken along line 4—4 in FIG. 2.

The improved tubing hanger 10 and improved annulus valve 12 are shown in the drawings. Tubing hanger 10 shown in FIG. 1 is positioned within and landed upon the internal landing seat 14 of well housing 16. Suitable means 18 are provided to secure hanger 10 in its landed position. Passageway 20 extending through hanger 10 and is interrupted by chamber 22. The end of passageway 20 facing chamber 22 are recessed to receive seat rings 24 both above and below chamber 22. Seat rings 24 include means for sealing against the walls of the recesses in which they are positioned and include a spherical seating surface surrounding their ends facing into chamber 22. Valve ball 26 is mounted on pin 28 and shaft 30. As best seen in FIG. 4, chamber 22 is formed in hanger 10 as a bore 32. Pin 28 is secured centrally at the inner end of bore 32 as shown and valve ball 26 is inserted between seat rings 24 which have previously been installed in their respective recesses. Shaft 30 is secured into the exterior of ball 26 in alignment with pin 28 and together they provide the turning axis for ball 26. Shaft 30 extends through plate 34, and pinion gear 36 with a suitable splined connection and into bearing 38 positioned within plug 40. Plug 40 is threaded into the outer end of bore 32 and is sealed therein by suitable seals 42. Bore 32 is open to the interior of tubing hanger 10 at its intermediate portion so that the teeth of pinion gear 36 can mesh with the teeth on the exterior of rack 44 which is mounted on the exterior of sleeve 46.

Sleeve 46 is positioned within the bore 48 of tubing hanger 10 immediately below tree stab sub 50 and includes extension 52 which is positioned within counterbore 54 of tubing hanger 10 above hanger extension piece 56. Sleeve 46 includes external recess 58 in which rack 44 is secured in an axially extending orientation and in engagement with pinion gear 36. The upper exterior surface 60 of sleeve 46 fits tightly within bore 48 and seals 62 positioned in grooves in bore 48 provide the seal against surface 60. The central exterior projection 64 of sleeve 46 fits against the surface of counterbore 54 and seals 66 provide sealing therebetween above and below the communication between the interior of hanger 10 and bore 32. Lower exterior surface 68 of sleeve 46 is positioned within the interior of hanger extension piece 56 and seals 70 positioned in grooves therein provide sealing against surface 68. Shoulder 72 on sleeve 46 between upper surface 60 and projection 64 forms a stop limiting the upward movement of sleeve 46 by its engagement of shoulder 74 between bore 48 and counterbore 54 and shoulder 76 on sleeve 46 between projection 64 and lower exterior surface 68 forms a stop limiting the downward movement of sleeve 46 by its engagement with the upper end of hanger extension piece 56.

Figure 2:
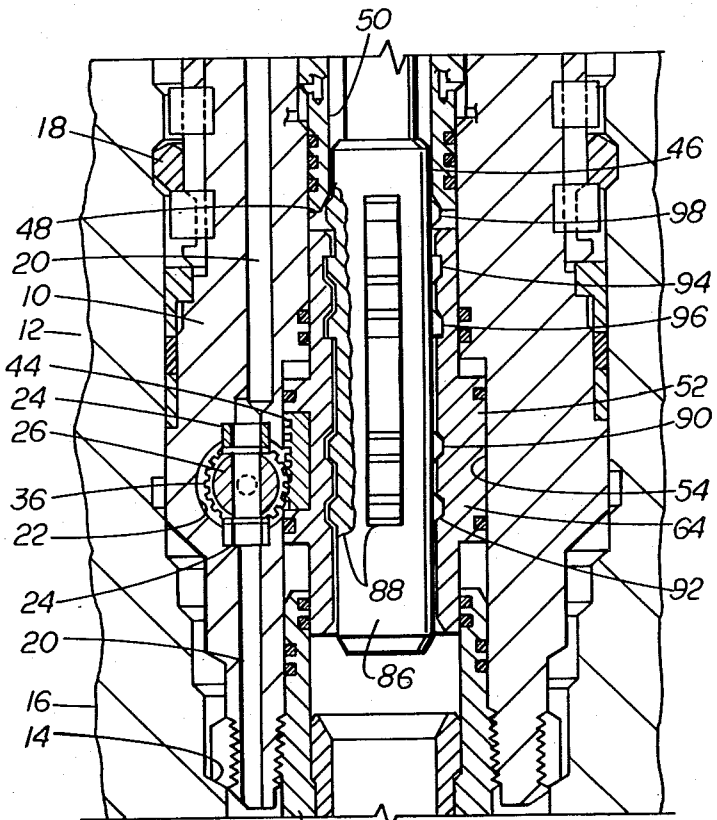
FIG. 2 is an enlarged sectional view of the improved tubing hanger annulus valve illustrating the valve in open position.

The interior of sleeve 46 includes a plurality of grooves 78, 80, 82 and 84 which are utilized for the engagement of sleeve 46 by either of the shifting tools. As shown in FIG. 2, shifting tool 86 is used to engage sleeve 46 and raise it to its upper position as shown. Shifting tool 86 includes dogs 88 having lower projections 90 and 92 which engage within lower grooves 82 and 84 and its upper projections 94 and 96 are positioned within upper grooves 78 and 80 and upper projection 98 is positioned within the space between the upper end of sleeve 46 and the lower end of sub 50. In this position the upward movement of sleeve 46 has moved rack 44 upward to rotate pinion gear 36 and valve ball 26 to the valve open position shown, opening the flow through annulus passageway 20. When this shifting of sleeve 46 is complete, continued upward movement causes the upper taper on upper projection 98 to engage the taper on the lower end of sub 50 camming dogs 88 into tool 86 and thus releases the engagement of the shoulders on projections 94 and 96 with the shoulders in grooves 78 and 80.

The shifting of sleeve 46 to its lower position is accomplished with shifting tool 100. Shifting tool 100 includes dogs 102 which engage in the lower three grooves 80, 82 and 84 with the upper projection 104 engaging in groove 80 and having its shoulder exert the downward force on the groove 80 shoulder. The movement of sleeve 46 to its lower position moves rack 44 downward with it and rotates pinion gear 36 so that valve ball 26 is rotated to its closed positioned, thereby closing flow through annulus passageway 20. Shifting tool 100 is removed by lifting it with sufficient force so that the taper on its projections coact with the tapers on the grooves 80, 82 and 84 to cam dogs 102 inwardly and allow retrieval of tool 100.

What is claimed is:

1. A tubing hanger comprising an annular hanger body having a tubular wall with a central bore and a counterbore below the bore, a sleeve positioned within said bore and having an external annular projection positioned within said counterbore and a rack secured on the exterior of said annular projection, means on the interior of said sleeve to receive a tool for the shifting of said sleeve axially in said bore, a passageway extending vertically through the wall of said hanger body with a chamber interrupting said passageway, a valve ball having a bore therethrough, positioned within said chamber and mounted for rotation in said chamber to align said valve ball bore with said passageway to allow flow through the valve ball bore in one position and to close said passageway in its second position, and gear means being in engagement with said rack whereby when said sleeve with said rack thereon is moved axially within said bore and counterbore said valve ball is rotated between its positions to control flow through said passageway.

2. A tubing hanger according to claim 1 including the chamber of said passageway including an upper and a lower opening into the chamber, a seat ring secured within each of the openings of said passageway into said chamber and forming the valve seats against which said valve ball seats.

3. A tubing hanger according to claim 1 including a shaft mounted for rotation on said hanger within said chamber and secured to said valve ball and to said gear means.

4. A tubing hanger according to claim 3 wherein said gear means includes a pinion gear mounted on said shaft and engaging said rack whereby movement of said rack rotates said valve ball between open and closed positions.

5. A tubing hanger according to claim 3 including bearing means supporting said shaft for rotation within said chamber.

* * * * *